US005516448A

United States Patent [19]

Capeci et al.

[11] Patent Number: 5,516,448

[45] Date of Patent: May 14, 1996

[54] PROCESS FOR MAKING A HIGH DENSITY DETERGENT COMPOSITION WHICH INCLUDES SELECTED RECYCLE STREAMS FOR IMPROVED AGGLOMERATE

[75] Inventors: Scott W. Capeci, North Bend, Ohio; John F. Lange, Villa Hills, Ky.; David J. Smith, Kenton; Nigel S. Roberts, Jesmond, both of Great Britain

[73] Assignee: The Procter & Gamble Company, Cincinnati, Ohio

[21] Appl. No.: 309,290

[22] Filed: Sep. 20, 1994

[51] Int. Cl.[6] ..... C11D 11/00; C11D 17/06

[52] U.S. Cl. ..... 252/89.1; 252/174; 252/135; 252/174.23; 264/117; 264/140

[58] Field of Search ..... 252/89.1, 90, 174, 252/135, 174.23; 264/117, 140, 118, 128

[56] References Cited

U.S. PATENT DOCUMENTS

| | | | |
|---|---|---|---|
| 1,157,935 | 10/1915 | Gray . | |
| 1,634,640 | 7/1927 | Zizinia . | |
| 2,004,840 | 6/1935 | Suchtelen | 159/4 |
| 2,900,256 | 8/1959 | Scott | 99/56 |
| 3,143,428 | 8/1964 | Reimers et al. | 99/141 |
| 3,148,070 | 9/1964 | Mishkin et al. | 99/71 |
| 3,354,933 | 11/1967 | Wengeler | 159/48 |
| 3,547,179 | 12/1970 | Hussmann | 159/4 |
| 3,626,672 | 12/1971 | Burbidge | 55/185 |
| 3,629,951 | 12/1971 | Davis et al. | 34/33 |
| 3,703,772 | 11/1972 | McHugh et al. | 34/9 |
| 3,842,888 | 10/1974 | Gibbons | 159/4 CC |
| 3,882,034 | 5/1975 | Gibbons | 252/99 |
| 4,005,987 | 2/1977 | Jury | 23/313 FB |
| 4,244,698 | 1/1981 | King et al. | 23/313 FB |
| 4,261,958 | 4/1981 | Pevzner et al. | 423/121 |
| 4,482,630 | 11/1984 | Allen et al. | 435/187 |
| 4,487,710 | 12/1984 | Kaminsky | 252/546 |
| 4,806,261 | 2/1989 | Ciallella et al. | 252/90 |
| 4,818,424 | 4/1989 | Evans et al. | 252/91 |
| 4,828,721 | 5/1989 | Bollier et al. | 252/8.7 |
| 4,846,409 | 7/1989 | Kaspar et al. | 241/21 |
| 4,894,117 | 1/1990 | Bianchi et al. | 159/49 |
| 4,919,847 | 4/1990 | Barletta et al. | 252/558 |
| 4,925,585 | 5/1990 | Strauss et al. | 252/89.1 |
| 4,946,653 | 8/1990 | Stopp et al. | 422/140 |
| 5,108,646 | 4/1992 | Beerse et al. | 252/174.25 |
| 5,133,924 | 7/1992 | Appel et al. | 264/342 R |
| 5,139,749 | 8/1992 | White | 422/200 |
| 5,160,657 | 11/1992 | Bortolotti et al. | 252/174.14 |
| 5,164,108 | 11/1992 | Appel et al. | 252/174 |
| 5,198,145 | 3/1993 | Lobunez et al. | 252/174.14 |
| 5,205,958 | 4/1993 | Swatling et al. | 252/174.13 |
| 5,366,652 | 11/1994 | Capeci et al. | 252/89.1 |

FOREIGN PATENT DOCUMENTS

| | | | |
|---|---|---|---|
| 118692 | 7/1944 | Australia | 28.6 36.4 |
| 0351937 | 1/1990 | European Pat. Off. | C11D 11/00 |
| 0451894A1 | 10/1991 | European Pat. Off. | C11D 10/04 |
| 0510746 | 10/1992 | European Pat. Off. . | |
| 0508543A1 | 10/1992 | European Pat. Off. | C11D 71/06 |
| 1517713 | 7/1978 | United Kingdom | C11D 17/06 |

OTHER PUBLICATIONS

Naviglio and Moriconi, "Detergents Manufacture," *Soap/Cosmetics/Chemical Specialties,* Sep. 1987, pp. 34–37, 54–56.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for continuously preparing high density detergent composition is provided. The process comprises the steps of: (a) continuously charging a detergent surfactant paste and dry starting detergent material into a high speed mixer/densifier to obtain agglomerates; (b) mixing the agglomerates in a moderate speed mixer/densifier to further densify, build-up and agglomerate the agglomerates; (c) feeding the agglomerates into a conditioning apparatus for improving the flow properties of the agglomerates and for separating the agglomerates into a first agglomerate mixture and a second agglomerate mixture; (d) recycling the first agglomerate mixture into the high speed mixer/densifier for further agglomeration; (e) admixing adjunct detergent ingredients to the second agglomerate mixture so as to form the high density detergent composition.

18 Claims, 2 Drawing Sheets

PROCESS FOR MAKING A HIGH DENSITY DETERGENT COMPOSITION WHICH INCLUDES SELECTED RECYCLE STREAMS FOR IMPROVED AGGLOMERATE

FIELD OF THE INVENTION

The present invention generally relates to a process for producing a high density laundry detergent composition. More particularly, the invention is directed to a continuous process during which high density detergent agglomerates are produced by feeding a surfactant paste and dry starting detergent material into two serially positioned mixer/densifiers and then into drying, cooling and screening apparatus. The process includes optimally selected recycle stream configurations so as to produce a high density detergent composition with improved flow and particle size properties. Such improved properties enhance consumer acceptance of the detergent composition produced by the instant process.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example, with a density of 600 g/l or higher. The low dosage detergents are currently in high demand as they conserve resources and can be sold in small packages which are more convenient for consumers.

Generally, there are two primary types of processes by which detergent particles or powders can be prepared. The first type of process involves spray-drying an aqueous detergent slurry in a spray-drying tower to produce highly porous detergent particles. In the second type of process, the various detergent components are dry mixed after which they are agglomerated with a binder such as a nonionic or anionic surfactant. In both processes, the most important factors which govern the density of the resulting detergent material are the density, porosity, particle size and surface area of the various starting materials and their respective chemical composition. These parameters, however, can only be varied within a limited range. Thus, a substantial bulk density increase can only be achieved by additional processing steps which lead to densification of the detergent material.

There have been many attempts in the art for providing processes which increase the density of detergent particles or powders. Particular attention has been given to densification of spray-dried particles by "post-tower" treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide a continuous processes for increasing the density of "post-tower" or spray dried detergent particles. Typically, such processes require a first apparatus which pulverizes or grinds the particles and a second apparatus which increases the density of the pulverized particles by agglomeration. These processes achieve the desired increase in density only by treating or densifying "post tower" or spray dried particles.

However, all of the aforementioned processes are directed primarily for densifying or otherwise processing spray dried particles. Currently, the relative amounts and types of materials subjected to spray drying processes in the production of detergent particles has been limited. For example, it has been difficult to attain high levels of surfactant in the resulting detergent composition, a feature which facilitates production of low dosage detergents. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of pastes, liquids and dry materials can be effectively agglomerated into crisp, free flowing detergent agglomerates having a high density of at least 650 g/l. Moreover, such agglomeration processes have produced detergent agglomerates containing a wide range of particle sizes, for example "overs" and "fines" are typically produced. The "overs" or larger than desired agglomerate particles have a tendency to decrease the overall solubility of the detergent composition in the washing solution which leads to poor cleaning and the presence of insoluble "clumps" ultimately resulting in consumer dissatisfaction. The "fines" or smaller than desired agglomerate particles have a tendency to "gel" in the washing solution and also give the detergent product an undesirable sense of "dustiness." Further, past attempts to recycle such "overs" and "fines" has resulted in the exponential growth of additional undesirable over-sized and under-sized agglomerates since the "overs" typically provide a nucleation site or seed for the agglomeration of even larger particles, while recycling "fines" inhibits agglomeration leading to the production of more "fines" in the process.

Accordingly, there remains a need in the art for a process which produces a high density detergent composition having improved flow and particle size properties. Also, there remains a need for such a process which is more efficient and economical to facilitate large-scale production of low dosage or compact detergents.

BACKGROUND ART

The following references are directed to densifying spray-dried granules: Appel et al, U.S. Pat. No. 5,133,924 (Lever); Bortolotti et at, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Hollingsworth et al, European Patent Application 351,937 (Unilever); and Swatling et at, U.S. Pat. No. 5,205,958.

SUMMARY OF THE INVENTION

The present invention meets the aforementioned needs in the an by providing a process which continuously produces a high density detergent composition containing agglomerates directly from starting detergent ingredients. Consequently, the process achieves the desired high density detergent composition without unnecessary process parameters, such as the use of spray drying techniques and relatively high operating temperatures, all of which increase manufacturing costs. The process invention described herein also provides a detergent composition containing agglomerates having improved flow and particle size (i.e. more uniform) properties which ultimately results in a low dosage or compact detergent product having more acceptance by consumers. As used herein, the term "agglomerates" refers to particles formed by agglomerating starting detergent ingredients (liquid and/or particles) which typically have a smaller median particle size than the formed agglomerates. All percentages and ratios used herein are expressed as percentages by weight (anhydrous basis) unless otherwise indicated. All documents are incorporated herein by reference. All viscosities referenced herein are measured at 70° C. (±5° C.) and at shear rates of about 10 to 100 $sec^{-1}$.

In accordance with one aspect of the invention, a process for continuously preparing high density detergent composition is provided. The process comprises the steps of: (a) continuously charging a detergent surfactant paste and dry starting detergent material into a high speed mixer/densifier to obtain agglomerates; (b) mixing the agglomerates in a moderate speed mixer/densifier to densify, build-up and agglomerate the agglomerates such that the finished agglomerates have a median particle size from about 300 microns to about 900 microns; (c) feeding the agglomerates into a conditioning apparatus for improving the flow properties of the agglomerates and for separating the agglomerates into a first agglomerate mixture and a second agglomerate mixture, wherein the first agglomerate mixture substantially has a particle size of less than about 150 microns and the second agglomerate mixture substantially has a particle size of at least about 150 microns; (d) recycling the first agglomerate mixture into the high speed mixer/densifier for further agglomeration; (e) admixing adjunct detergent ingredients to the second agglomerate mixture so as to form the high density detergent composition.

In accordance with another aspect of the invention, another process for continuously preparing high density detergent composition is provided. This process comprises the steps of: (a) continuously charging a detergent surfactant paste and dry starting detergent material into a high speed mixer/densifier to obtain agglomerates; (b) mixing the agglomerates in a moderate speed mixer/densifier to further densify and agglomerate the agglomerates such that the agglomerates have a median particle size of from about 300 microns to about 900 microns; (c) screening the agglomerates so as to form a first agglomerate mixture substantially having a particle size of at least about 6 mm and a second agglomerate mixture substantially having a particle size of less than about 6 mm; (d) feeding the first agglomerate mixture to a grinding apparatus and the second agglomerate mixture to a conditioning apparatus for improving the flow properties of the second agglomerate mixture and for separating the second agglomerate mixture into a third agglomerate mixture and a fourth agglomerate mixture, wherein the third agglomerate mixture substantially has a particle size of less than about 150 microns and the fourth agglomerate mixture substantially has a particle size of at least about 150 microns; (e) recycling the third agglomerate mixture into the high speed mixer/densifier for further agglomeration; (f) separating the fourth agglomerate mixture into a fifth agglomerate mixture and a sixth agglomerate mixture, wherein the fifth agglomerate mixture substantially has a particle size of at least about 900 microns and the sixth agglomerate mixture has a median particle size of from about 50 microns to about 1400 microns; (g) inputting the fifth agglomerate mixture into the grinding apparatus for grinding with the first agglomerate mixture to form a ground agglomerate mixture which is recycled into the conditioning apparatus; and (h) admixing adjunct detergent ingredients to the sixth agglomerate mixture so as to form the high density detergent composition. Another aspect of the invention is directed to a high density detergent composition made according to any one of the embodiments of the instant process.

Accordingly, it is an object of the invention to provide a process which produces a high density detergent composition containing agglomerates having improved flow and particle size properties. It is also an object of the invention to provide such a process which is more efficient and economical to facilitate large-scale production of low dosage or compact detergents. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

Figure 1:
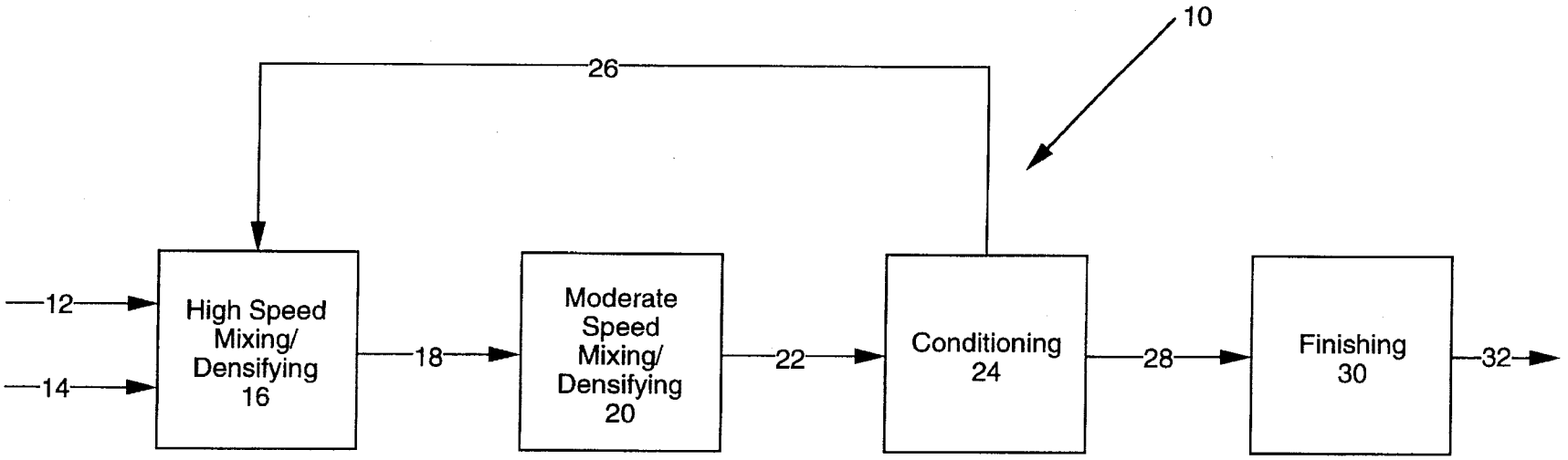
FIG. 1 is a flow diagram of a process in accordance with one embodiment of the invention in which undersized detergent agglomerates are recycled back into the high speed mixer/densifier from the conditioning apparatus.
Figure 2:
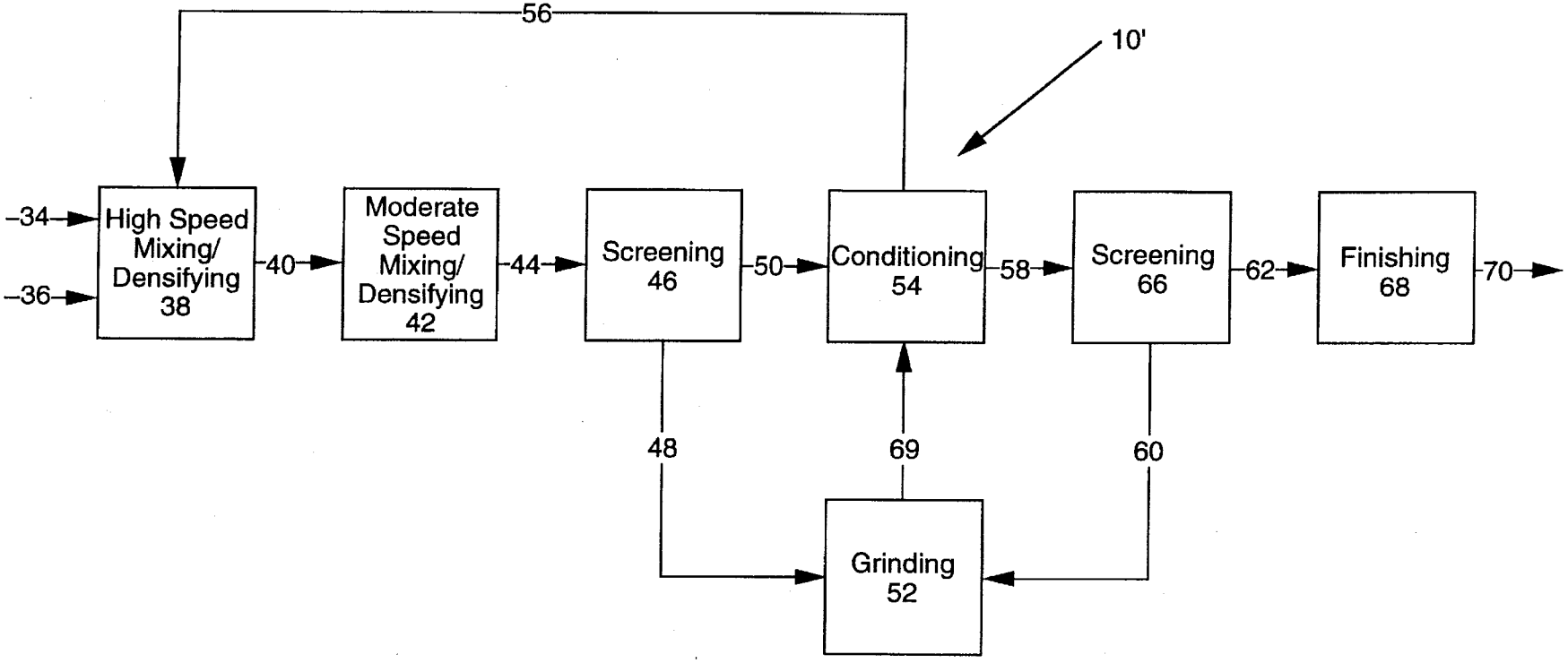
FIG. 2 is a flow diagram of a process in accordance with another embodiment of the invention similar to FIG. 1 in which an additional recycling operation is included for purposes of further improving the properties of the resulting detergent product.

Reference can be made to FIGS. 1 and 2 for purposes of illustrating several embodiments of the process invention described herein. FIG. 1 illustrates a process 10 while FIG. 2 depicts a process 10' which is a modified version of process 10.

Process

Initially, the process 10 shown in FIG. 1 entails continuously charging a detergent surfactant paste 12 and dry starting detergent material 14 into a high speed mixer/densifier 16 to obtain agglomerates 18. The various ingredients which may be selected for the surfactant paste 12 and the dry starting detergent material 14 are described more fully hereinafter. However, it is preferable for the ratio of the surfactant paste to the dry detergent material to be from about 1:10 to about 10:1 and more preferably from about 1:4 to about 4:1. The agglomerates 18 are then sent or fed to a moderate speed mixer/densifier 20 to densify and build-up further and agglomerate the agglomerates 18 such that they have the preferred median particle size range of from about 300 microns to about 900 microns.

It should be understood that the dry starting detergent material 14 and surfactant paste 12 begin to build-up into agglomerates in the high speed mixer/densifier 16, thus resulting in the agglomerates 18. The agglomerates 18 are then built-up further in the moderate speed mixer/densifier 20 resulting in further densified or built-up agglomerates 22 which are ready for further processing to increase their flow properties.

Typical apparatus used in process 10 for the high speed mixer/densifier 16 include but are not limited to a Lödige Recycler CB-30 while the moderate speed mixer/densifier 20 can be a Lödige Recycler KM-600 "Ploughshare". Other apparatus that may be used include conventional twin-screw mixers, mixers commercially sold as Eirich, Schugi, O'Brien, and Drais mixers, and combinations of these and other mixers. Residence times of the agglomerates/ingredients in such mixer/densifiers will vary depending on the particular mixer/densifier and operating parameters. However, the preferred residence time in the high speed mixer/densifier 16 is from about 2 seconds to about 45 seconds, preferably from about 5 to 30 seconds, while the residence time in the moderate speed mixer/densifier is from about 0.5 minutes to about 15 minutes, preferably from about 1 to 10 minutes.

The moderate speed mixer/densifier 20 preferably imparts a requisite amount of energy to the agglomerates 18 for further build-up or agglomeration. More particularly, the moderate speed mixer/densifier 20 imparts from about $5\times10^{10}$ erg/kg to about $2\times10^{12}$ erg/kg at a rate of from about $3\times10^{8}$ erg/kg-sec to about $3\times10^{9}$ erg/kg-sec to form agglomerates 22. The energy input and rate of input can be determined by calculations from power readings to the moderate speed mixer/densifier 20 with and without agglomerates, residence time of the agglomerates, and the mass of the agglomerates in the moderate speed mixer/densifier 20. Such calculations are clearly within the scope of the skilled artisan.

Optionally, a coating agent can be added just before, in or after the mixer/densifier 20 to control or inhibit the degree of agglomeration. This optional step provides a means by which the desired agglomerate particle size can be achieved. Preferably, the coating agent is selected from the group consisting of aluminosilicates, carbonates, silicates and mixtures thereof. Another optional step entails spraying a binder material into the high speed mixer/densifier 16 so as to facilitate build-up agglomeration. Preferably, the binder is selected from the group consisting of water, anionic surfactants, nonionic surfactants, polyethylene glycol, polyvinyl pyrrolidone, polyacrylates, citric acid and mixtures thereof.

Another step in the process 10 entails feeding the further densified agglomerates 22 into a conditioning apparatus 24 which preferably includes one or more of a drying apparatus and a cooling apparatus (not shown individually). The conditioning apparatus 24 in whatever form (fluid bed dryer, fluid bed cooler, airlift, etc.) is included for improving the flow properties of the agglomerates 22 and for separating them into a first agglomerate mixture 26 and a second agglomerate mixture 28. Preferably, the agglomerate mixture 26 substantially has a particle size of less than about 150 microns and the agglomerate mixture 28 substantially has a particle size of at least about 150 microns. Of course, it should be understood by those skilled in the art that such separation processes are not always perfect and there may be a small protion of agglomerate particles in agglomerate mixture 26 or 28 which is outside the recited size range. The ultimate goal of the process 10, however, is to divide a substantial portion of the "fines" or undersized agglomerates 26 from the more desired sized agglomerates 28 which are then sent to one or more finishing steps 30.

The agglomerate mixture 26 is recycled back into the high speed mixer/densifier 16 for further agglomeration such that the agglomerates in mixture 26 are ultimately built-up to the desired agglomerate particle size. Preferably, the finishing steps 30 will include admixing adjunct detergent ingredients to agglomerate mixture 28 so as to form a fully formulated high density detergent composition 32 which is ready for commercialization. In a preferred embodiment, the detergent composition 32 has a density of at least 650 g/l. Optionally, the finishing steps 30 includes admixing conventional spray-dried detergent particles to the agglomerate mixture 28 along with adjunct detergent ingredients to form detergent composition 32. In this case, detergent composition 32 preferably comprises from about 10% to about 40% by weight of the agglomerate mixture 28 and the balance spray-dried detergent particles and adjunct ingredients.

Reference is now made to FIG. 2 which depicts process 10' for making a high density detergent composition in accordance with the invention. Similar to process 10, the process 10' comprises the steps of continuously charging a detergent surfactant paste 34 and dry starting detergent material 36 into a high speed mixer/densifier 38 to obtain agglomerates 40 and, mixing the agglomerates 40 in a moderate speed mixer/densifier 42 to densify and build-up further and agglomerate the agglomerates 40 into agglomerates 44. The agglomerates 44 preferably have a median particle size from about 300 microns to about 900 microns. Thereafter, the agglomerates 44 are screened in screening apparatus 46 so as to form a first agglomerate mixture 48 substantially having a particle size of at least about 6 mm and a second agglomerate mixture 50 substantially having a particle size of less than about 6 mm. The agglomerate mixture 48 contains relatively wet oversized agglomerates and usually represents about 2 to 5% of the agglomerates 44 prior to screening.

The agglomerate mixture 48 is fed to a grinding apparatus 52 while the agglomerate mixture 50 is fed to a conditioning apparatus 54 for improving the flow properties of the agglomerate mixture 50 and for separating the agglomerate mixture 50 into a third agglomerate mixture 56 and a fourth agglomerate mixture 58. Preferably, the agglomerate mixture 56 substantially has a particle size of less than about 150 microns and the agglomerate mixture 58 substantially has a particle size of at least 150 microns. The process 10' entails recycling the agglomerate mixture 56 back into the high speed mixer/densifier 38 for further agglomeration as described with respect to process 10 in FIG. 1. Thereafter, the agglomerate mixture 58 is separated via any known process/apparatus such as with conventional screening apparatus 66 or the like into a fifth agglomerate mixture 60 and a sixth agglomerate mixture 62. Preferably, the agglomerate mixture 60 substantially has a particle size of at least 900 microns (preferably larger than 1180 microns) and the agglomerate mixture 62 has a median particle size of from about 50 microns to about 1400 microns (preferably from about 50 microns to about 1180 microns).

The agglomerate mixture 60 which contains additional oversized agglomerate particles is inputted into the grinding apparatus 52 for grinding with the agglomerate mixture 48 which also contains oversized agglomerate particles to form a ground agglomerate mixture 64. Continuous with the foregoing operations, the agglomerate mixture 64 is recycled back into the conditioning apparatus 54 which may include one or more fluid bed dryers and coolers as described previously. In such cases, the recycle stream of agglomerate mixture 64 can be sent to any one or a combination of such fluid bed dryers and coolers without departing from the scope of the invention. The agglomerate mixture 62 is then subjected to one or more finishing steps 68 as described previously. Preferably, the process 10' includes the step of admixing adjunct detergent ingredients to the agglomerate mixture 62 so as to form the high density detergent composition 70 which has a density of at least 650 g/l.

The optional steps discussed with respect to the process 10 are equally applicable with respect to process 10'. By way of example, a coating agent can be added in or after the moderate speed mixer/densifier 42 to control or inhibit the degree of agglomeration. It has been found that adding a coating agent to the agglomerate mixture 62 or 58, i.e., before or after between the screening apparatus 66, yields a detergent composition with surprisingly improved flow properties. As mentioned previously, the coating agent is preferably selected from the group consisting of aluminosilicates, carbonates, silicates and mixtures thereof. The other optional steps such as spraying a binder material into the high speed mixer/densifier 38 are useful in process 10' for purposes of facilitating build-up agglomeration. The residence times, energy input parameters, surfactant paste characteristics and ratios with starting dry detergent ingredients are all also preferably incorporated into the process 10'.

Detergent Surfactant Paste

The detergent surfactant paste used in the processes 10 and 10' is preferably in the form of an aqueous viscous paste, although forms are also contemplated by the invention. This so-called viscous surfactant paste has a viscosity of from about 5,000 cps to about 100,000 cps, more preferably from about 10,000 cps to about 80,000 cps, and contains at least about 10% water, more preferably at least about 20% water. The viscosity is measured at 70° C. and at shear rates of about 10 to 100 $sec.^{-1}$. Furthermore, the surfactant paste, if used, preferably comprises a detersive surfactant in the amounts specified previously and the balance water and other conventional detergent ingredients.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 92/06154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the processes 10 and 10' preferably comprises a detergency builder selected from the group consisting of aluminosilicates, crystalline layered silicates and mixtures thereof, and carbonate, preferably sodium carbonate. The aluminosilicates or aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the aforementioned Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates the process of the invention which produces free flowing, crisp, high density detergent composition. Two feed streams of various detergent starting ingredients are continuously fed, at a rate of 2800 kg/hr, into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the mean residence time is about 10 seconds. The agglomerates from the Lödige CB-30 mixer/densifier are continuously fed into a Lödige KM-600 mixer/densifier for further agglomeration during which the mean residence time is about 6 minutes. The resulting detergent agglomerates are then fed to conditioning apparatus including a fluid bed dryer and then to a fluid bed cooler, the mean residence time being about 10 minutes and 15 minutes, respectively. The undersized or "fine" agglomerate particles (less than about 150 microns) from the fluid bed dryer and cooler are recycled back into the Lödige CB-30 mixer/densifying. A coating agent, aluminosilicate, is fed immediately after the Lödige KM-600 mixer/densifier but before the fluid bed dryer to enhance the flowability of the agglomerates. The detergent agglomerates exiting the fluid bed cooler are screened, after which adjunct detergent ingredients are admixed therewith to result in a fully formulated detergent product having a uniform particle size distribution. The composition of the detergent agglomerates exiting the fluid bed cooler is set forth in Table I below:

TABLE I

| Component | % Weight |
|---|---|
| $C_{14-15}$ alkyl sulfate/alkyl ethoxy sulfate | 30.0 |
| Aluminosilicate | 37.8 |
| Sodium carbonate | 19.1 |
| Misc. (water, perfume, etc.) | 13.1 |
| | 100.0 |

The density of the agglomerates in Table I is 750 g/l and the median particle size is 475 microns.

Adjunct liquid detergent ingredients including perfumes, brighteners and enzymes are sprayed onto or admixed to the agglomerates/particles described above in the finishing step to result in a fully formulated finished detergent composition. The relative proportions of the overall finished detergent composition produced by the process of instant process is presented in Table II below:

TABLE II

| Component | (% weight) A |
|---|---|
| $C_{14-15}$ alkyl sulfate/$C_{14-15}$ alkyl ethoxy sulfate/$C_{12}$ linear alkylbenzene sulfonate | 21.6 |
| Polyacrylate (MW = 4500) | 2.5 |
| Polyethylene glycol (MW = 4000) | 1.7 |
| Sodium Sulfate | 6.9 |
| Aluminosilicate | 25.6 |
| Sodium carbonate | 17.9 |
| Protease enzyme | 0.3 |
| Cellulase enzyme | 0.4 |
| Lipase enzyme | 0.3 |
| Minors (water, perfume, etc.) | 22.8 |
| | 100.0 |

The density of the detergent composition in Table II is 660 g/l.

EXAMPLE II

This Example illustrates another process in accordance with the invention in which the steps described in Example I are performed in addition to the following steps: (1) screening the agglomerates exiting the Lödige KM-600 such that the oversized particles (at least about 4 mm) are sent to a grinder; (2) screening the oversized agglomerate particles (at least about 1180 microns) exiting the fluid bed cooler and sending those oversized particles to the grinder, as well; and (3) inputting the ground oversized particles back into the fluid bed dryer and/or fluid bed cooler. Additionally, a coating agent, aluminosilicate, is added between the fluid bed cooler and the finishing (admixing and/or spraying adjunct ingredients) steps. The composition of the detergent agglomerates exiting the fluid bed cooler is set forth in Table III below:

TABLE III

| Component | % Weight |
|---|---|
| $C_{14-15}$ alkyl sulfate/alkyl ethoxy sulfate | 30.0 |
| Aluminosilicate | 37.8 |
| Sodium carbonate | 19.1 |
| Misc. (water, perfume, etc.) | 13.1 |
| | 100.0 |

The density of the agglomerates in Table I is 750 g/l and the median particle size is 425 microns. The agglomerates also surprisingly have a more narrow particle size distribution, wherein more than 90% of the agglomerates have a particle size between about 150 microns to about 1180 microns. This result unexpectedly matches the desired agglomerate particle size distribution (i.e. all agglomerates below 1180 microns) more closely.

Adjunct liquid detergent ingredients including perfumes, brighteners and enzymes are sprayed onto or admixed to the agglomerates/particles described above in the finishing step to result in a fully formulated finished detergent composition. The relative proportions of the overall finished detergent composition produced by the process of instant process is presented in Table IV below:

TABLE IV

| Component | (% weight) B |
|---|---|
| $C_{14-15}$ alkyl sulfate/$C_{14-15}$ alkyl ethoxy sulfate/$C_{12}$ linear alkylbenzene sulfonate | 21.6 |
| Polyacrylate (MW = 4500) | 2.5 |
| Polyethylene glycol (MW = 4000) | 1.7 |
| Sodium Sulfate | 6.9 |
| Aluminosilicate | 25.6 |
| Sodium carbonate | 17.9 |
| Protease enzyme | 0.3 |
| Cellulase enzyme | 0.4 |
| Lipase enzyme | 0.3 |
| Minors (water, perfume, etc.) | 22.8 |
| | 100.0 |

The density of the detergent composition in Table IV is 660 g/l.

Having thus described the invention in detail, it will be clear to those skilled in the art that various changes may be made without departing from the scope of the invention and the invention is not to be considered limited to what is described in the specification.

What is claimed is:

1. A process for continuously preparing high density detergent composition comprising the steps of:

(a) continuously charging a detergent surfactant paste and dry starting detergent material into a high speed mixer/densifier to obtain agglomerates, wherein the mean residence time in said high speed mixer/densifier is from about 2 seconds to about 45 seconds;

(b) mixing said agglomerates in a moderate speed mixer/densifier to further densify, build-up and agglomerate said agglomerates such that said agglomerates have a median particle size from about 300 microns to about 900 microns, wherein the mean residence time in said moderate speed mixer/densifier is from about 0.5 minutes to about 15 minutes;

(c) feeding said agglomerates into a conditioning apparatus for improving the flow properties of said agglomerates and for separating said agglomerates into a first agglomerate mixture and a second agglomerate mixture, wherein said first agglomerate mixture substantially has a particle size of less than about 150 microns and said second agglomerate mixture substantially has a particle size of at least about 150 microns;

(d) recycling said first agglomerate mixture into said high speed mixer/densifier for further agglomeration;

(e) admixing adjunct detergent ingredients to said second agglomerate mixture so as to form said high density detergent composition.

2. A process according to claim 1 wherein said conditioning apparatus comprises a fluid bed dryer and a fluid bed cooler.

3. A process according to claim 1 wherein the ratio of said surfactant paste to said dry detergent material is from about 1:10 to about 10:1.

4. A process according to claim 1 wherein said ratio of said surfactant paste to said dry detergent material is from about 1:4 to about 4:1.

5. A process according to claim 1 wherein said dry starting material comprises a builder selected from the group consisting of aluminosilicates, crystalline layered silicates, and mixtures thereof and sodium carbonate.

6. A process according to claim 1 wherein the density of said detergent composition is at least 650 g/l.

7. A process according to claim 1 further comprising the step of adding a coating agent after said moderate speed mixer/densifier, wherein said coating agent is selected from the group consisting of aluminosilicates, carbonates, silicates and mixtures thereof.

8. A process according to claim 1 further comprising the step of spraying a binder material into said high speed mixer/densifier.

9. A process according to claim 8 wherein said binder is selected from the group consisting of water, anionic surfactants, nonionic surfactants, polyethylene glycol, polyvinyl pyrrolidone, polyacrylates, citric acid and mixtures thereof.

10. A process according to claim 1 wherein said surfactant paste has a viscosity of from about 5,000 cps to about 100,000 cps.

11. A process according to claim 1 wherein said surfactant paste comprises water and a surfactant selected from the group consisting of anionic, nonionic, zwitterionic, ampholytic and cationic surfactants and mixtures thereof.

12. A process according to claim 1 wherein said moderate speed mixer/densifier imparts from about $5\times10^{10}$ erg/kg to about $2\times10^{12}$ erg/kg of energy at a rate of from about $3\times10^{8}$ erg/kg-sec to about $3\times10^{9}$ erg/kg-sec.

13. A process according to claim 1 further comprising the step of adding a coating agent in said moderate speed mixer/densifier.

14. A process for continuously preparing high density detergent composition comprising the steps of:

(a) continuously charging a detergent surfactant paste and dry starting detergent material into a high speed mixer/densifier to obtain agglomerates, wherein the mean residence time of said agglomerates in said high speed mixer/densifier is from about 2 seconds to about 45 seconds;

(b) mixing said agglomerates in a moderate speed mixer/densifier to further densify, build-up and agglomerate said agglomerates such that said agglomerates have a median particle size from about 300 microns to about 900 microns, wherein the mean residence time of said agglomerates in said moderate speed mixer/densifier is from about 0.5 minutes to about 15 minutes;

(c) screening said agglomerates so as to form a first agglomerate mixture substantially having a particle size of at least about 6 mm and a second agglomerate mixture substantially having a particle size of less than 6 mm;

(d) feeding said first agglomerate mixture to a grinding apparatus and said second agglomerate mixture to a conditioning apparatus for improving the flow properties of said second agglomerate mixture and for separating said second agglomerate mixture into a third agglomerate mixture and a fourth agglomerate mixture, wherein said third agglomerate mixture substantially has a particle size of less than about 150 microns and said fourth agglomerate mixture substantially has a particle size of at least about 150 microns;

(e) recycling said third agglomerate mixture into said high speed mixer/densifier for further agglomeration;

(f) separating said fourth agglomerate mixture into a fifth agglomerate mixture and a sixth agglomerate mixture, wherein said fifth agglomerate mixture has a particle size of at least about 900 microns and said sixth agglomerate mixture has a median particle size of from about 50 microns to about 1400 microns;

(g) inputting said fifth agglomerate mixture into said grinding apparatus for grinding with said first agglomerate mixture to form a ground agglomerate mixture which is recycled into said conditioning apparatus; and (h) admixing adjunct detergent ingredients to said sixth agglomerate mixture so as to form said high density detergent composition.

15. A process according to claim 14 further comprising the step of adding a coating agent to said sixth agglomerate mixture between said separation step and said admixing step, wherein said coating agent is selected from the group consisting of aluminosilicates, carbonates, silicates and mixtures thereof.

16. A process according to claim 14 wherein said conditioning apparatus comprises a fluid bed dryer and a fluid bed cooler.

17. A high density detergent composition made according to the process of claim 1.

18. A high density detergent composition made according to the process of claim 14.

* * * * *